US006977465B2

(12) United States Patent
Saldaña et al.

(10) Patent No.: US 6,977,465 B2
(45) Date of Patent: Dec. 20, 2005

(54) IMAGE INTENSIFIER WITH IMPROVED ELECTROMAGNETIC COMPATIBILITY

(75) Inventors: Michael R. Saldaña, New Braunfels, TX (US); Robert S. Delzell, Garland, TX (US); David G. Couch, Garland, TX (US); Duke L. Hogan, Richardson, TX (US); Thomas M. Daley, Mesa, AZ (US); Chuck Min Lee, Chandler, AZ (US); David B. Johnson, Phoenix, AZ (US)

(73) Assignee: Litton Systems, Inc., Woodland Hills, CA (US)

( * ) Notice: Subject to any disclaimer, the term of this patent is extended or adjusted under 35 U.S.C. 154(b) by 416 days.

(21) Appl. No.: 10/174,427

(22) Filed: Jun. 17, 2002

(65) Prior Publication Data

US 2003/0230706 A1 Dec. 18, 2003

(51) Int. Cl.[7] ..... H01J 40/06; H01J 40/00; H01J 40/16

(52) U.S. Cl. ..... 313/544; 313/542; 313/537

(58) Field of Search ..... 313/540, 542, 313/544, 106, 523; 250/214 VT, 239, 485.1

(56) References Cited

U.S. PATENT DOCUMENTS

| | | | | |
|---|---|---|---|---|
| 3,733,492 | A * | 5/1973 | Hagar | 250/214 VT |
| 4,924,080 | A | 5/1990 | Caserta et al. | 361/111 |
| 5,118,925 | A * | 6/1992 | Mims et al. | 250/214 VT |
| 5,757,118 | A * | 5/1998 | Kubo | 313/365 |
| 6,121,103 | A | 9/2000 | Tully et al. | 438/381 |
| 6,140,574 | A | 10/2000 | Snyder | 174/35 |
| 6,153,271 | A | 11/2000 | Mearini | 427/529 |
| 6,327,073 | B1 * | 12/2001 | Yahav et al. | 359/321 |

FOREIGN PATENT DOCUMENTS

| | | | |
|---|---|---|---|
| EP | 0 434 157 A2 | 6/1991 | H01J 31/50 |
| EP | 1 139 382 A2 | 10/2001 | H01J 29/98 |
| GB | 1 424 876 | 2/1976 | H01J 31/50 |

* cited by examiner

*Primary Examiner*—Nimeshkumar D. Patel
*Assistant Examiner*—Matt Hodges
(74) *Attorney, Agent, or Firm*—Fulbright & Jaworski LLP

(57) ABSTRACT

An image intensifier includes a photocathode (11) with a face plate (22). A conductive layer (24) is disposed outwardly from the face plate (22). A grounded conductor (16) is electrically coupled to the conductive layer (24) and grounds the conductive layer (24).

14 Claims, 4 Drawing Sheets

IMAGE INTENSIFIER WITH IMPROVED ELECTROMAGNETIC COMPATIBILITY

TECHNICAL FIELD OF THE INVENTION

This invention relates generally to the field of electro-optical systems and more specifically to an image intensifier.

BACKGROUND OF THE INVENTION

Image intensifiers such as night vision systems may employ a gated power supply. Gated power supplies, however, may cause undesirable radiated emissions from a cathode in the image intensifier. Consequently, designing image intensifiers with gated power supplies has posed challenges.

SUMMARY OF THE INVENTION

In accordance with the present invention, an image intensifier is provided that may substantially eliminate or reduce the disadvantages and problems associated with previously developed systems and methods.

According to one embodiment of the present invention, an image intensifier includes a photocathode with a face plate. An optically transparent, conductive layer is disposed outwardly from the face plate. A grounded conductor is electrically coupled to the conductive layer and grounds the conductive layer.

Certain embodiments of the invention may provide numerous technical advantages. A technical advantage of one embodiment may be reducing radiated emissions from a cathode of an image intensifier by using a grounded conductive layer. Another technical advantage of one embodiment may be reducing radiated emissions from a cathode using a window with a conductive layer coupled to the cathode.

A technical advantage of one embodiment is that a portion of the window of the image intensifier is not coated and thus may be polished without damaging the conductive layer. A technical advantage of another embodiment is that during manufacture, the conductive layer may be disposed outwardly from the window, which may then may be cut to a suitable shape, allowing for efficient formation of the window.

Other technical advantages are readily apparent to one skilled in the art from the following figures, descriptions, and claims.

BRIEF DESCRIPTION OF THE DRAWINGS

For a more complete understanding of the present invention and for further features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 4 of the drawings, like numerals being used for like and corresponding parts of the various drawings.

Figure 1A:
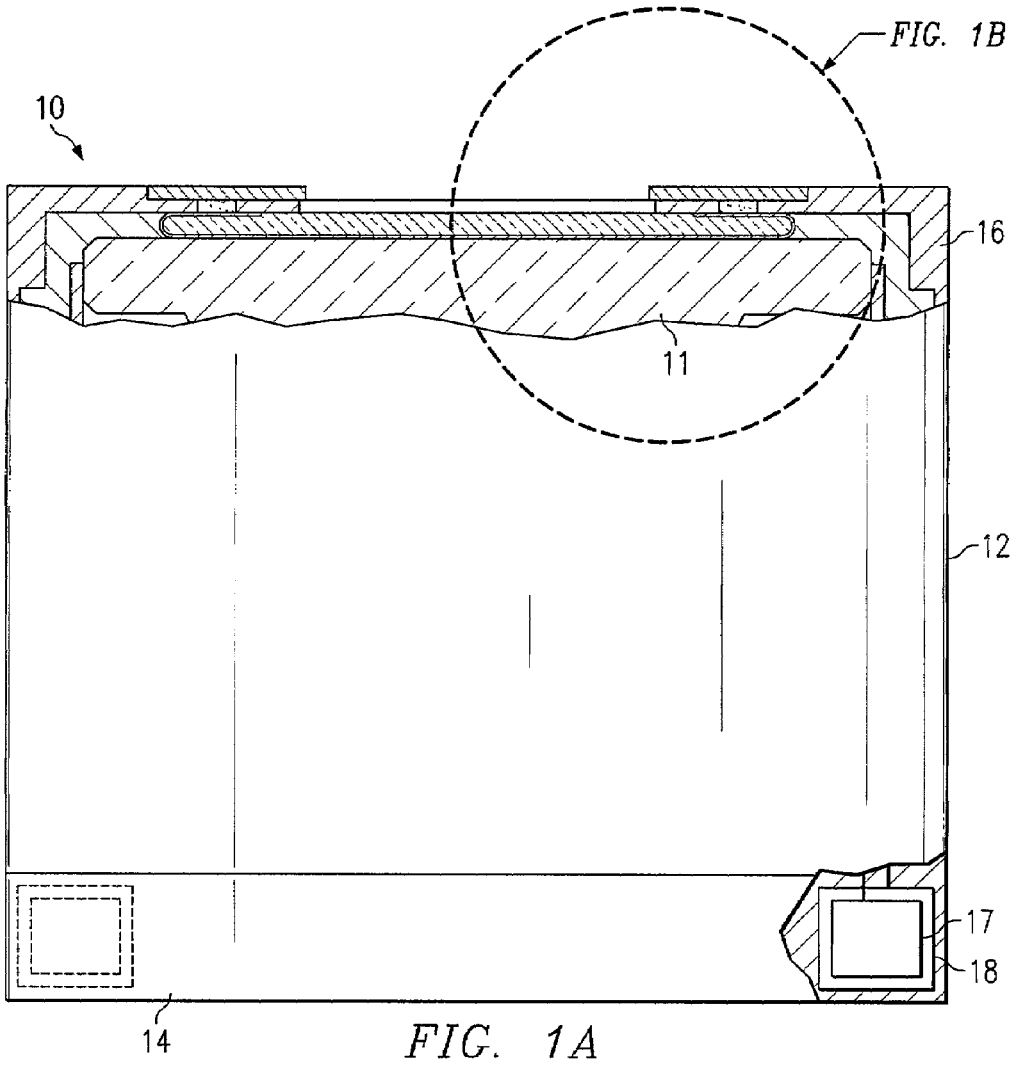
FIGS. 1A and 1B illustrate one embodiment of an image intensifier.

FIG. 1A illustrates one embodiment of an image intensifier 10 for reducing radiated emissions. Image intensifier 10 may comprise, for example, an image intensifier that may be used in a night vision system or a non-imaging radiation detector. Image intensifier 10 includes a cathode 11 within a housing 12. Cathode 11 may comprise a photocathode of a phototube such as an MX-10160B phototube. Housing 12 may be substantially cylindrical in shape with a base 14, and comprise a grounded, electrically conductive material. Housing 12 may also include an input housing portion 16, which is described in more detail with reference to FIG. 1B.

A power supply 17 with a power supply housing 18 may be coupled to housing 12. Power supply 17 may comprise a gated power supply. The gated power supply may supply a high voltage gating signal that creates an electric field emission from cathode 11. The radiated emission may be undesirable, and may cause cathode 11 to fail to satisfy radiated emission performance specifications. Power supply 17 may be shaped to fit around cathode 11. For example, power supply 17 may be annular in shape with an inner diameter that is approximately equivalent to an outer diameter of cathode 11. Housing 12 and/or power supply housing 18 may be grounded.

Figure 1B:
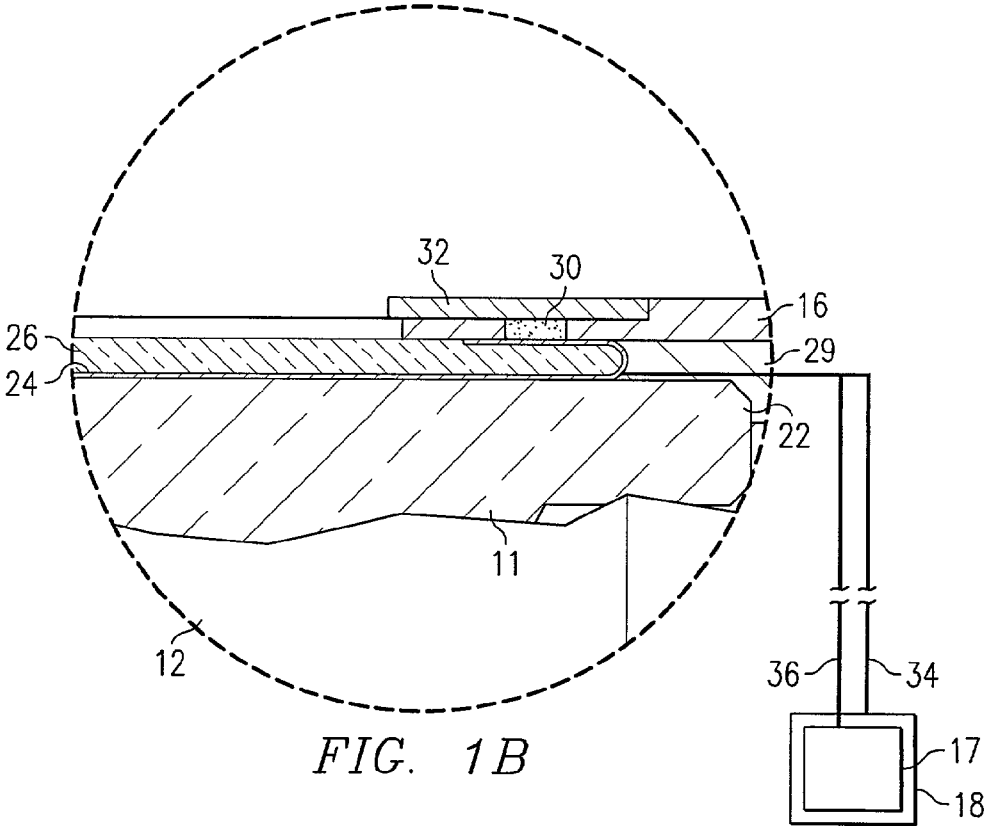

FIG. 1B illustrates a more detailed portion of image intensifier 10 of FIG. 1A. In one embodiment, cathode 11 includes a face plate 22. Face plate 22 may comprise glass or other suitable substantially transparent material. In this document, "transparent" is defined to mean transparent to, for example, infrared, visible, and/or ultraviolet light, for example, at least approximately 95% transmission for wavelengths from approximately 360 nanometers to 900 nanometers.

A conductive layer 24 is disposed outwardly from face plate 22. Conductive layer 24 may comprise a transparent conductive material such as indium tin oxide. Conductive layer 24 is grounded, which may shield cathode 11 and reduce radiated emissions from cathode 11. Window 26 is disposed outwardly from conductive layer 24, and may comprise glass such as Corning 7056 glass or other suitable transparent material. Window 26 is described in more detail with reference to FIG. 2. Window 26 and conductive layer 24 may be optically bonded to face plate 22. Window 26 and face plate 22 may have substantially similar thermal expansion properties.

Conductive layer 24 may be placed outwardly from face plate 22 in any suitable manner. For example, conductive layer 24 may be deposited outwardly from face plate 22, and window 26 may be placed outwardly from conductive layer 24. Alternatively, conductive layer 24 may be deposited outwardly from window 26, and then conductive layer 24 may be bonded to face plate 22.

Input housing portion 16 is disposed outwardly from a portion of window 26. Input housing portion 16 may comprise metal, plastic, metallized plastic, or any other suitable housing material. In one embodiment, the surface of input housing portion 16 may define any number of holes, for example, four to six holes, approximately equidistant around input housing portion 16. The surface may comprise a plating material. In one embodiment, a conductive plug 30 may be disposed within each hole in order to electrically couple conductive layer 24 to input housing portion 16, which may provide a ground for conductive layer 24. "Each" as used in this document means each member of a set or each member of a subset of a set. Conductive plug 30 may comprise silver epoxy or any other suitable conductive material.

A potting material 29 may be deposited in between face plate 22 and input housing portion 16. Potting material may comprise, for example, silicone. A glare shield 32 may be disposed outwardly from input housing portion 16. Glare shield 32 may be annular in shape with an inner diameter approximately equivalent to a diameter of an opening for window 26.

In one embodiment, a wire 34 may electrically couple conductive layer 24 to power supply housing 18, which may provide a ground for conductive layer 24. In another embodiment, a ground wire 36 of power supply 17 may be electrically coupled to conductive layer 24, which may provide a ground for conductive layer 24.

Figure 2A:
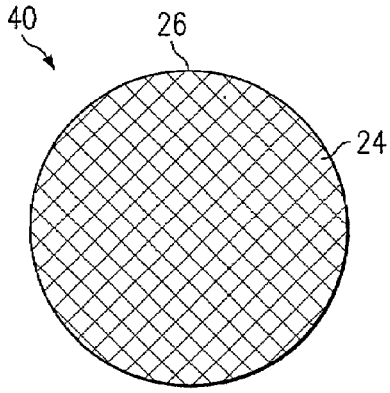
FIGS. 2A and 2B illustrate one embodiment of a window of the image intensifier of FIGS. 1A and 1B.
Figure 2B:
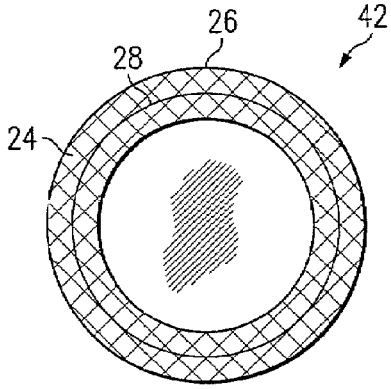

FIGS. 2A and 2B illustrate one embodiment of window 26. FIG. 2A illustrates a first side 40 of window 26. Conductive layer 24 is deposited outwardly from first side 40 by sputtering conductive layer 24 on first side 40. Conductive layer 24 may have a transmission rating and a conductivity rating suitable for shielding radiated emissions from cathode 11, for example, at least ninety-five percent transmission at approximately 830 nanometers, and approximately 1000 ohms per square centimeter conductivity. First side 40 may be bonded to face plate 22.

FIG. 2B illustrates a second side 42 of window 26. Conductive layer 24 may be deposited outwardly from a periphery of window 26 by shielding an inner portion of second side 42 with a mask and sputtering conductive layer 24 on second side 42. First side 40 may be sputtered during a first cycle, and second side 42 may be sputtered during a second cycle. The area of window 26 that is not coated may be polished without damaging conductive layer 24. A bonding layer 28 may be deposited outwardly from conductive layer 24 on second side 42 of window 26. Bonding layer 28 may provide a surface for bonding window 26 to input housing portion 16. Bonding layer 28 may be annular in shape and may comprise chromium or any other material suitable for providing a surface for bonding.

Figure 3:
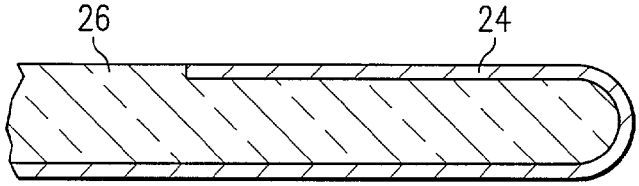
FIG. 3 illustrates a cross-section of the window of FIG. 2.

FIG. 3 illustrates a cross section of window 26 of FIG. 2. Window 26 may have a full edge radius. The full edge radius may allow for a more uniform deposition of conductive layer 24 on window 26. The more uniform deposition of conductive layer 24 may allow for front-to-back continuous conductivity.

Figure 4B:
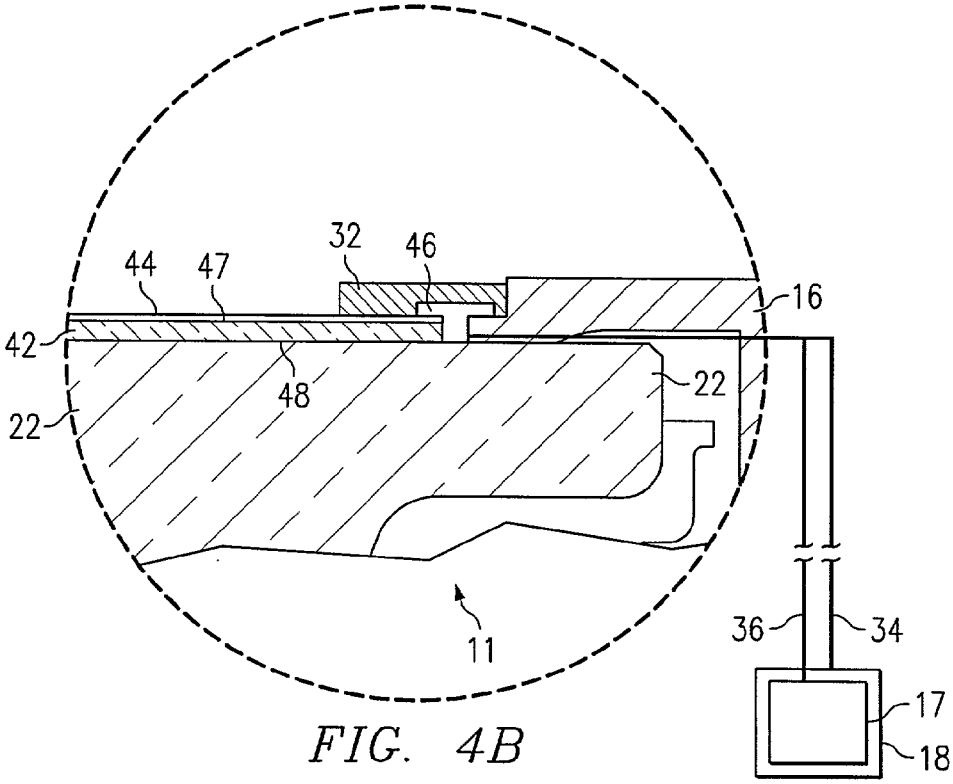
FIGS. 4A and 4B illustrate another embodiment of an image intensifier.
Figure 4A:
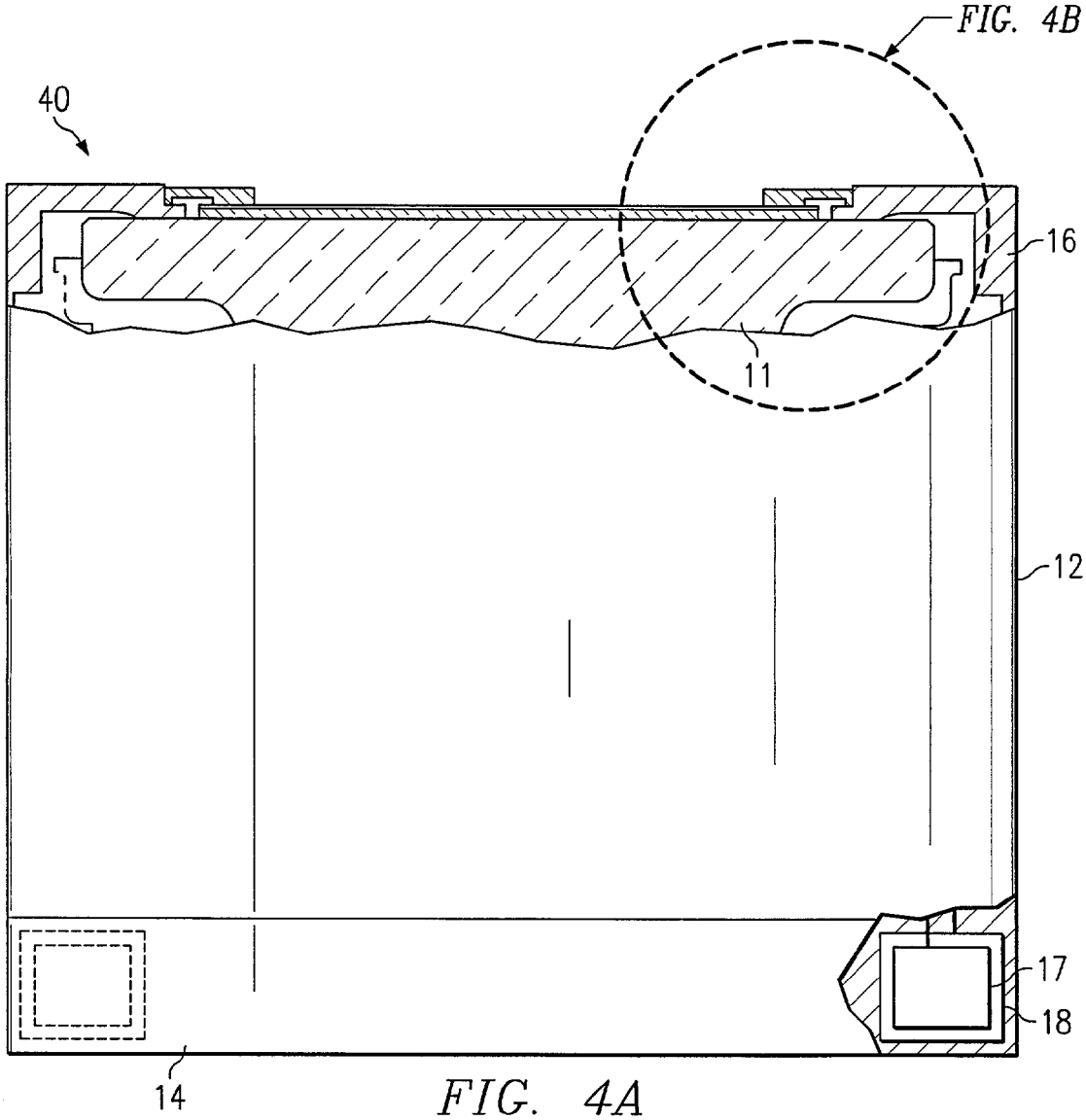

FIG. 4A illustrates another embodiment of an image intensifier 40 for reducing radiated emissions. Image intensifier 40 may include cathode 11 within housing 12. Housing 12 may include input housing portion 16. Power supply 17 with power supply housing 18 may be coupled to housing 12. Radiated emissions from power supply 17 may be undesirable, and may cause cathode 11 to fail to satisfy radiated emission performance specifications. Housing 12 and/or power supply housing 18 may be grounded.

FIG. 4B illustrates a more detailed portion of image intensifier 40 of FIG. 4A. In one embodiment, cathode 11 includes faceplate 22. A window 42 is disposed outwardly from faceplate 22, and may comprise glass such as Corning 7056 glass or other suitable transparent material. Window 42 may be optically bonded to faceplate 22 using any suitable adhesive such as an ultraviolet curable optical cement. Window 42 may be electrically conductive and optically transmissive. Window 42 and faceplate 22 may have substantially similar thermal expansion properties.

A conductive layer 44 is disposed outwardly from window 42. Conductive layer 44 may comprise a transparent conductive material such as indium tin oxide. Conductive layer 44 is grounded, which may shield cathode 11 and reduce radiated emissions from cathode. A conductive plug 46 may be disposed in a region formed by faceplate 22, window 42, and input housing portion 16. Conductive plug 46 may comprise a conductive silicone adhesive, and may be used to electrically couple conductive layer 44 to input housing portion 16. Glare shield 32 may be disposed outwardly from window 42, conductive plug 46, and input housing portion 16.

Cathode 11 may be at a post-production stage. Conductive layer 44 may be disposed outwardly from a first side 47 of window 42, and window 42 may be cut to a suitable shape, allowing for efficient formation of window 42. A second side 48 of window 42 may be coupled to faceplate 22.

In one embodiment, wire 34 may electrically couple conductive layer 44 to power supply housing 18, which may provide a ground for conductive layer 44. In another embodiment, ground wire 36 of power supply 17 may be electrically coupled to conductive layer 44, which may provide a ground for conductive layer 24.

Figure 5:
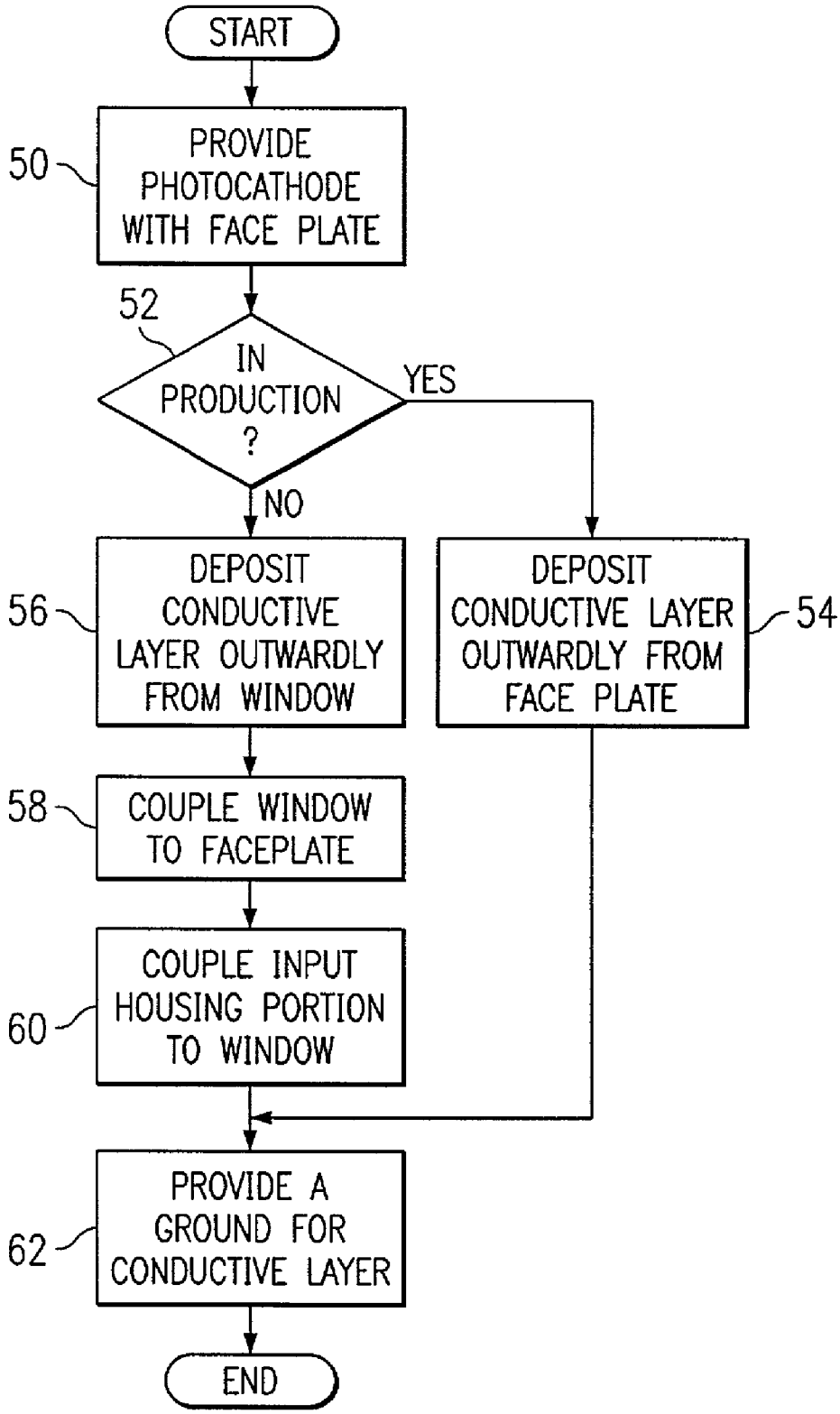
FIG. 5 illustrates an embodiment of a method for reducing radiated emissions of an image intensifier.

FIG. 5 illustrates an embodiment of a method for reducing radiated emissions of an image intensifier. The method begins at step 50, where cathode 11 with face plate 22 is provided. At step 52, it is determined whether cathode 11 is at a production stage or at a post-production stage. During the production stage, face plate 22 may be more easily coated. If cathode 11 is at a production stage, the method proceeds to step 54. At step 54, conductive layer 24 is deposited outwardly from face plate 22. Conductive layer 24 may be deposited by sputtering conductive layer 24 outwardly from face plate 22 to attain a transmission rating and a conductivity rating suitable for shielding radiated emissions from cathode 11. The method then proceeds to step 62.

If cathode 11 is at a post-production stage, the method proceeds to step 56. At step 56, conductive layer 24 is deposited outwardly from window 26. Conductive layer 24 may be deposited outwardly from window 26 by sputtering conductive layer 24 outwardly from window 26 to attain a transmission rating and a conductivity rating suitable for shielding radiated emissions from cathode 11. The method then proceeds to step 58.

At step 58, window 26 is coupled to face plate 22. Window 26 may be coupled to face plate 22 by optically bonding side 40 of window 26 to face plate 22 using any suitable lens bonding process to form image intensifier 10 of FIG. 1A. Alternatively, side 48 of window 42 may be optically bonded to face plate 22 using any suitable lens bonding process to form image intensifier 40 of FIG. 4A. At step 60, input housing portion 16 is coupled to window 26. Input housing portion 16 may be coupled to window 26 by depositing bonding layer 28 outwardly from side 42 of window 26, and electrically bonding input housing portion 16 to bonding layer 28.

At step 62, conductive layer 24 is grounded, which may shield radiated emissions from cathode 11. Conductive layer 24 may be grounded by coupling conductive layer 24 to a grounded conductor such as a grounded housing or a ground wire. In one embodiment, a grounded housing may comprise input housing portion 16. The surface of input housing portion 16 may define any number of holes suitable for providing a ground for conductive layer 24, for example, approximately four to six holes. The holes may be placed approximately equidistant around input housing portion 16.

A conductive plug 30 may be deposited within each hole to electrically couple conductive layer 24 and input housing portion 16.

In another embodiment, the grounded housing may comprise power supply housing 18. Wire 34 may be used to electrically couple conductive layer 24 and power supply housing 18. In another embodiment, conductive layer 24 may be grounded using ground wire 36 from power supply 17 by coupling ground wire 36 to conductive layer 24. After grounding conductive layer 24, the method terminates.

Certain embodiments of the invention may provide numerous technical advantages. A technical advantage of one embodiment may be reducing radiated emissions from cathode 11 of an image intensifier 10 by using grounded conductive layer 24. Another technical advantage of one embodiment may be reducing radiated emissions from cathode 11 by using window 26 with conductive layer 24 electrically coupled to cathode 11.

A technical advantage of one embodiment is that a portion of window 26 of image intensifier 10 is not coated and thus may be polished without damaging conductive layer 24. A technical advantage of another embodiment is that during manufacture, conductive layer 44 may be disposed outwardly from window 42, which may then may be cut to a suitable shape, allowing for efficient formation of window 42.

Although an embodiment of the invention and its advantages are described in detail, a person skilled in the art could make various alterations, additions, and omissions without departing from the spirit and scope of the present invention as defined by the appended claims.

What is claimed is:

1. An image intensifier, comprising:

a photocathode comprising a face plate;

a substantially flat conductive layer disposed outwardly from the face plate;

a grounded conductor electrically coupled to the conductive layer and operable to ground the conductive layer; and a window disposed outwardly from the conductive layer, the conductive layer deposited outwardly from the window.

2. An image intensifier, comprising:

a photocathode comprising a face plate;

a substantially flat conductive layer disposed outwardly from the face plate;

a grounded conductor electrically coupled to the conductive layer and operable to ground the conductive layer; and a window disposed outwardly from the conductive layer, the conductive layer deposited outwardly from a first side of the window, the conductive layer deposited outwardly from a periphery of a second side of the window.

3. The image intensifier of claim 1 or 2, wherein the grounded conductor comprises an input housing portion, the input housing portion comprising a surface defining a hole, a conductive plug disposed within the hole and electrically coupled to the conductive layer.

4. The image intensifier of claim 1 or 2, wherein the grounded conductor comprises a power supply housing.

5. The image intensifier of claim 1 or 2, wherein the grounded conductor comprises a ground wire of a power supply.

6. The image intensifier of claim 1 or 2, wherein the grounded conductor comprises an input housing portion, a conductive plug electrically coupling the conductive layer and the input housing portion.

7. The image intensifier of claim 1 or 2, wherein the photocathode comprises a gated photocathode.

8. A method for reducing radiated emissions from a photocathode, comprising:

providing a photocathode comprising a face plate;

depositing a substantially flat conductive layer outwardly from a window;

bonding the window to the face plate; and electrically coupling the conductive layer to a grounded conductor, wherein depositing the conductive layer further comprises:

depositing the conductive layer outwardly from a first side of the window;

depositing the conductive layer outwardly from a periphery of a second side of the window; and wherein bonding the window further comprises bonding the first side of the window to the face plate.

9. The method of claim 8, wherein electrically coupling the conductive layer to the grounded conductor comprises electrically coupling the conductive layer to a grounded housing, a surface of the grounded housing defining a hole, a conductive plug disposed within the hole and electrically coupled to the conductive layer.

10. The method of claim 8, wherein electrically coupling the conductive layer to the grounded conductor further comprises electrically coupling the conductive layer to a grounded wire of a power supply.

11. The method of claim 8, wherein electrically coupling the conductive layer to the grounded conductor further comprises electrically coupling the conductive layer to a grounded power supply housing.

12. The method of claim 8, wherein electrically coupling the conductive layer to the grounded conductor comprises electrically coupling the conductive layer to a grounded housing using a conductive plug electrically coupled to the conductive layer and the grounded housing.

13. The method of claim 8, wherein the photocathode comprises a gated photocathode.

14. An image intensifier, comprising:

a gated photocathode comprising a face plate;

a substantially flat conductive layer disposed outwardly from the face plate;

a window disposed outwardly from the conductive layer, the conductive layer deposited outwardly from a first side of the window, and the conductive layer deposited outwardly from a periphery of a second side of the window; and a grounded conductor electrically coupled to the conductive layer and operable to ground the conductive layer, the grounded conductor comprising an input housing portion, the input housing portion comprising a surface defining a hole, a conductive plug disposed within the hole and electrically coupled to the conductive layer.

* * * * *